United States Patent [19]

Yoshikawa

[11] Patent Number: 4,612,841

[45] Date of Patent: Sep. 23, 1986

[54] ELECTRONIC METRONOME

[75] Inventor: Haruzo Yoshikawa, Tokyo, Japan

[73] Assignee: Seiko Instruments & Electronics Ltd., Tokyo, Japan

[21] Appl. No.: 687,636

[22] Filed: Dec. 31, 1984

[51] Int. Cl.[4] ..... G10B 15/00

[52] U.S. Cl. ..... 84/484

[58] Field of Search ..... 84/477 B, 484; 318/685, 318/696; 368/134

[56] References Cited

U.S. PATENT DOCUMENTS 4,014,167 3/1977 Hasegawa et al. ..... 84/484

OTHER PUBLICATIONS

Japanese Publication Utility Model, No. 39389/82.

*Primary Examiner*—L. T. Hix
*Assistant Examiner*—Douglas S. Lee
*Attorney, Agent, or Firm*—Robert E. Burns; Emmanuel J. Lobato; Bruce L. Adams

[57] ABSTRACT

The electronic metronome has a baton reciprocatingly driven by a pulse-drive stepper motor powered by a varying voltage source. Drive circuitry generates and applies drive pulses to the stepper motor, each drive pulse being composed of a plurality of individual pulses having a pulse width which varies in accordance with variations of the voltage source and with the selected tempo at which the baton reciprocates. The stepper motor is thus driven at a constant torque-frequency characteristic despite fluctuations in the power source voltage and the tempo of the metronome.

8 Claims, 8 Drawing Figures

ELECTRONIC METRONOME

BACKGROUND OF THE INVENTION

This invention relates to an electronic metronome. More particularly, the present invention is directed to a metronome having a stepper motor driving system which attains constant torque-frequency characteristics of the stepper motor to thereby obtain an energy saving in the operation of the electronic metronome.

A variety of metronomes have been used conventionally. A typical construction is the mechanical metronome. Since the mechanical metronome uses a spring as the driving force, it has the drawback that the spring must be wound whenever the metronome is used.

An electronic metronome that has been used recently displays tempo and rhythm by means of sound and light, but its visible effect is no improvement over the conventional baton.

In order to obtain the baton effect described above, another kind of electronic metronome has been developed which uses an electric meter in combination with sound and light. However, the signal tracking characteristics of the pointer in the electric meter are not adequate, and this problem becomes particularly evident as the tempo or rhythm increases, hence, satisfactory characteristics can not be obtained. In connection with the electric meter, a large meter pointer can not be used due to the relatively small driving force; hence, it has been necessary to use a small meter pointer. Therefore, the effect of the meter was no improvement over the conventional baton.

In conjunction with the characteristics of the driving force of a stepper motor, the torque-frequency characteristics change remarkably depending upon the voltage parameter as shown in FIG. 3. Therefore, if the motor is always driven at a predetermined pulse width, the battery life is shortened, and irritating noise is present because excessive load is applied to the baton, and the service life of the motor is consequently shortened.

SUMMARY OF THE INVENTION

The present invention is directed to provide an extremely effective means for solving these problems and employs a construction in which the baton is reciprocatingly driven by the stepper motor, and pulse signal from a stepper motor driving signal generating portion and a pulse generating circuit are applied to a power controlling circuit so that the driving signal applied to the stepper motor becomes a comb tooth-like pulse and the driving torque is made substantially uniform.

In an electronic metronome having the construction described above, the baton can be operated electrically for a long time in the same way as a conventional mechanical metronome. Since the driving torque is made substantially uniform, the battery life is longer, and since excessive load is not applied to the baton, the noise is reduced and the motor life is increased.

DETAILED DESCRIPTION OF PREFERRED EMBODIMENTS

Figure 2:
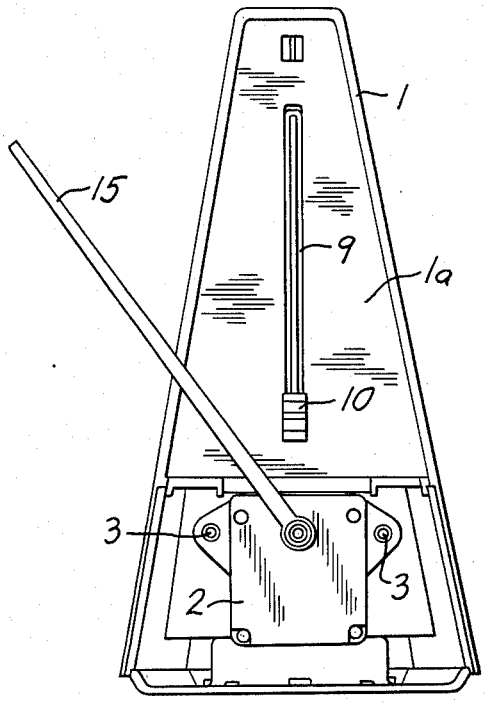
FIG. 2 is a front view of the metronome shown in FIG. 1.
Figure 1:
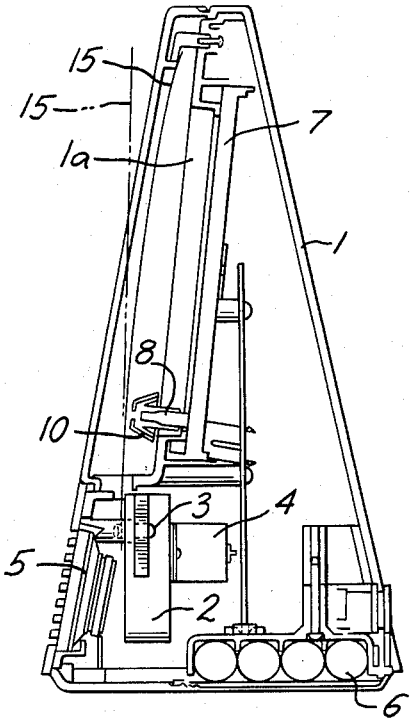
FIG. 1 is a sectional side view showing an electronic metronome in accordance with the present invention.
Figure 3:
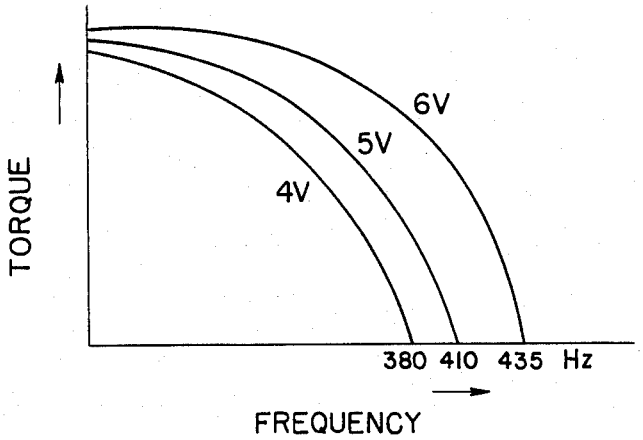
FIG. 3 is a torque-v-frequency characteristics diagram of an ordinary stepper motor.

Hereinafter, a preferred embodiment of the electronic metronome in accordance with the present invention will be described with reference to the accompanying drawings.

In the drawings, reference numeral 1 represents a frame which has a substantially trapezoidal shape, and a reduction gear assembly 2, which has a box-like shape as a whole, is fixed to the lower part of the frame by bolts 3. A stepper motor 4 is fitted to the outer side portion of the reduction gear assembly 2. A speaker 5 is disposed at the front position of the stepper motor 4, and a power source 6 consisting of batteries is disposed at the bottom of the frame 1.

A slide-type controller 7 is fitted to the front panel 1*a* of the frame 1, and an operating part 8 of the slide-type controller 7 penetrates through a guide hole 9 of the front panel 1*a* and projects outwardly therefrom. A button 10 is fitted to the operating part 8.

Figure 4:
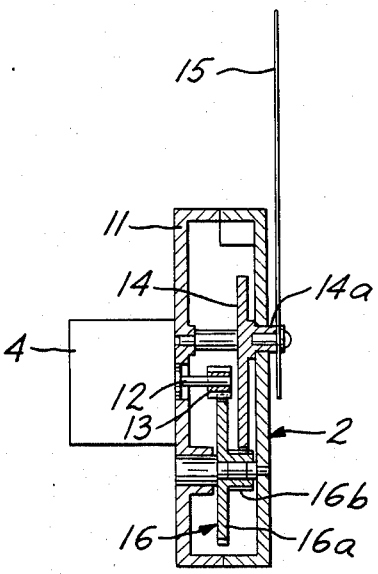
FIG. 4 is a sectional view showing principal portions of the metronome.
Figure 5:
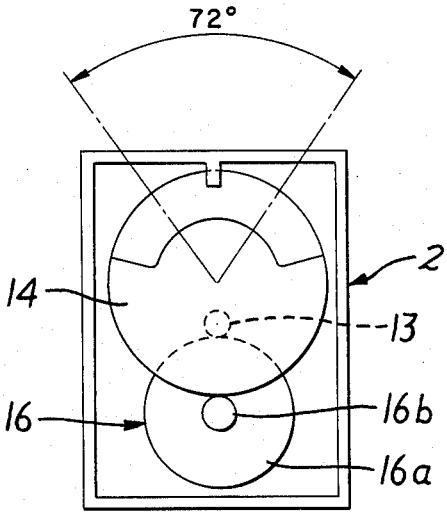
FIG. 5 is a front view of FIG. 4.

As shown in FIGS. 4 and 5, the reduction gear assembly 2 includes a rotary shaft 12 of the stepper motor 4 fitted to a casing 11, a pinion 13 integrally fitted to the rotary shaft 12, and a fan-shaped sector gear 14 disposed rotatably on the casing above the rotary shaft 12.

One of the ends 14*a* of the fan-shaped sector gear 14 projects outward from the casing 11, and a baton 15 is fixed integrally with the one end 14*a*.

A relay gear 16 is rotatably disposed at the lower part of the casing 11. The relay gear 16 has large diameter gear 16*a* which meshes with the pinion 13 and a small diameter gear 16*b* which meshes with the fan-shaped sector gear 14. Therefore, the pinion 13 and the fan-shaped sector gear 14 are connected by the relay gear 16 in an interlocking arrangement.

The stepper motor 4, the pinion 13, the relay gear 16 and the fan-shaped sector gear 14 are constructed in such a fashion as to satisfy the relation described below, and the angle of reciprocating displacement of the baton 15 is set to 72 degrees:

The rotational angle of displacement of the baton $$= \frac{N \times 1 \times m}{M \times n} \times 360^\circ$$

N . . . number of revolutions of the stepper motor 4

1 . . . number of teeth on the pinion gear 13 m . . . number of teeth on the small diameter relay gear 16*b*

M . . . number of teeth on the large diameter relay gear 16*a* n . . . number of teeth on the fan-shaped sector gear 14

$$= \frac{6.4 \times 15 \times 20}{80 \times 120} = 72^\circ$$

In the disclosed embodiment, the stepper motor 4 rotates through an angle of each drive 18° per pulse, and 20 drive pulses are necessary so that the stepper motor 4 rotates 360°. If the stepper motor 4 is designed in such a fashion that the baton 15 reverses direction when 128 drive pulses have been applied, the stepper motor 4 must make 6.4 revolutions, i.e., 128/20=6.4.

When 128 drive pulses are applied to this stepper motor 4, the pinion 13 also makes 6.4 revolutions, and thus the teeth of the pinion 13 undergo 15×6.4=96 steps, the large diameter gear 16*a* of the relay gear 16 moves 96/80=1.2 steps, and the small diameter gear 16*b* moves 20×1.2=24 steps. As the small diameter gear 16*b* moves 24 steps, the fan-shaped sector gear rotates 24/100 of a revolution, and the baton 15 moves 360°×24/120=72 degrees.

Figure 6:
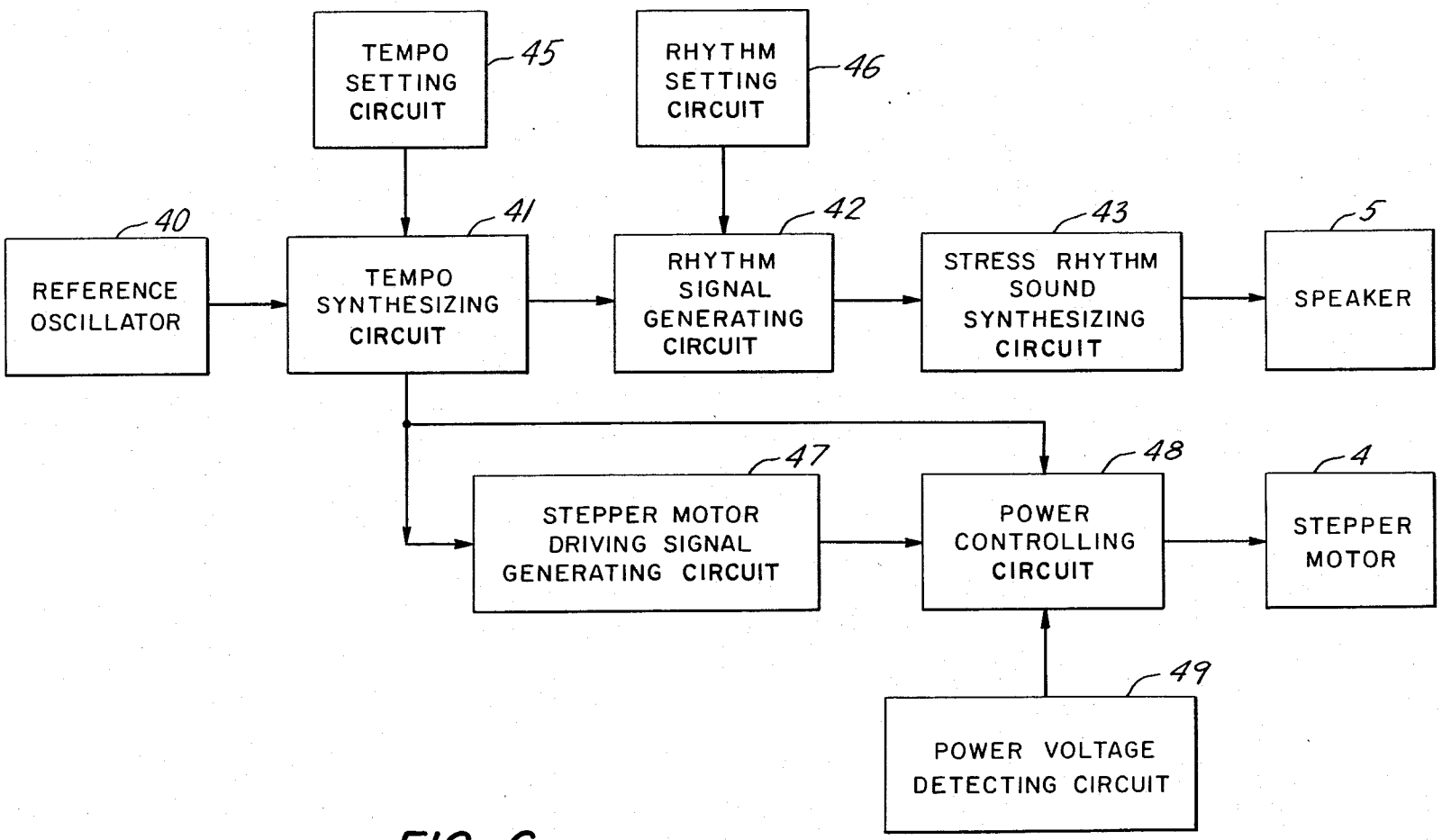
FIG. 6 is a block diagram showing the overall construction of the metronome.

The construction of an electric circuit constituting the electronic metronome of this invention is illustrated in FIG. 6. A reference signal from a reference oscillator 40 is applied to a tempo synthesizing circuit 41, a rhythm signal generating circuit 42, a stress rhythm sound synthesizing circuit 43 and then to the speaker 5. A tempo setting circuit 45 is connected to the tempo synthesizing circuit 41 and a rhythm setting circuit 46 is connected to the rhythm signal generating circuit 42.

An output signal from the tempo synthesizing circuit 41 is applied to a stepper motor driving signal generating circuit 47 and to a power controlling circuit 48. The output signal of the stepper motor driving signal generating circuit 47 is applied to the power controlling circuit 48. A detection signal from a power voltage detecting circuit 49 is applied to the power controlling circuit 48, and the output signal of the power controlling circuit 48 is applied to the stepper motor 4.

The power controlling circuit 48 and the stepper motor driving signal generating circuit 47 will be described in more detail with reference to FIG. 7. The signal from the tempo synthesizing circuit 41 and the signal from the power voltage detection circuit 49 are applied to a pulse generating circuit 52 through an operational circuit 51, the analog signal from the power voltage detecting circuit 49 first being converted into a digital signal by an analog-to-digital converter 50. The pulse generating circuit 52 is constructed such that it can change the pulse width of the pulses generated thereby at a duty ratio of from 1/16 to 16/16 so as to generate comb-tooth pulses of a duty ratio that is arbitrarily set and calculated by the operational circuit 51 on the basis of the input tempo signal and a voltage detection signal.

Figure 7:
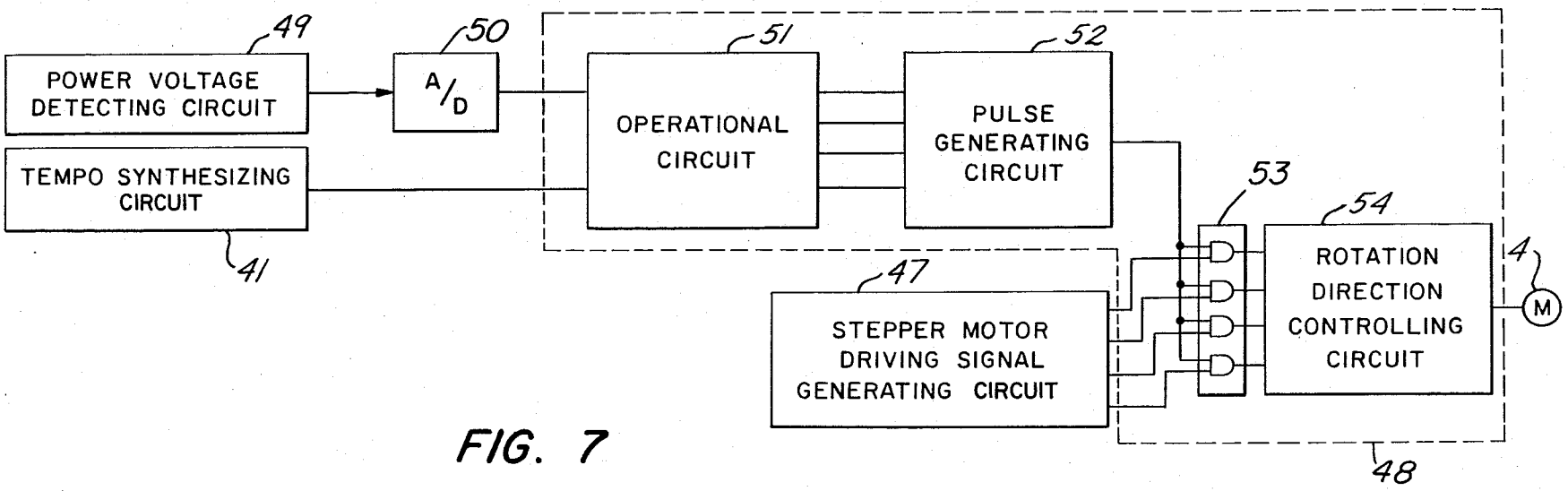
FIG. 7 is a circuit diagram showing the construction of the circuitry for effecting power control.
Figure 8:
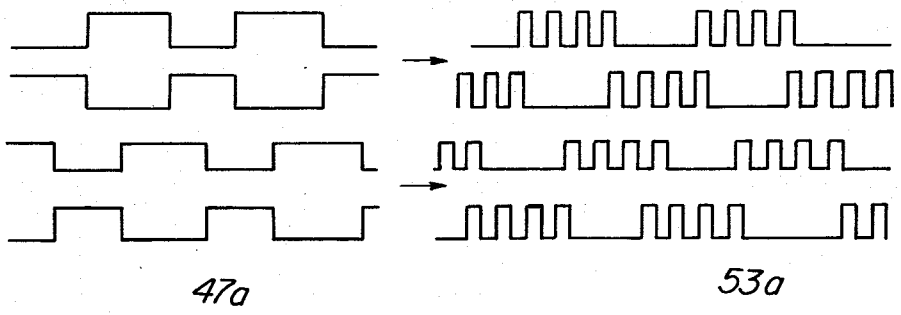
FIG. 8 is a waveform diagram of a stepper motor driving waveform.

The output from the pulse generating circuit 52 is applied to a group of AND circuits 53 connected to the stepper motor driving signal generating circuit 47 as shown in FIGS. 7 and 8, the stepper motor driving signal generating circuit 47 produces a four-phase pulse signal 47*a* which is fed together with the comb-tooth pulses produced by the pulse generating circuit 52 to each AND circuit 53 which applies a comb-tooth, four-phase drive pulse signal 53*a* produces a four-phase pulse signal 47*a* which is fed together with the comb-tooth pulses produced by the pulse generating circuit 52 to the stepper motor 4 through a rotation direction controlling circuit 54 so as to alternately drive the stepper motor 4 in forward and reverse directions.

The electronic metronome of the invention having the construction described above is operated in the following manner. First, the button 10 of the slide type controller 7 is slid to adjust to an arbitrary tempo and rhythm, and the power source is then turned on. The step motor 4 is driven by the comb-tooth drive signal 53 *a* composed of discrete drive pulse groups each having a plurality of individual pulses whose pulse width or duty ratio is controlled by the pulse generating circuit 52 of the power controlling circuit 48. The motor 4 changes its direction of rotation every 128 drive pulses, (corresponding to 72° angular displacement of the baton) and a sound is generated from the speaker 5 when the baton 15 changes its direction of motion.

Since the electronic metronome in accordance with the present invention has the construction and action described above, the baton can be operated electrically for a long time in entirely the same way as the conventional mechanical metronome. Since the stepper motor changes direction of rotation after each succession of 128 pulses by applying a large number of comb-tooth pulses, the battery life is increased. Since no excessive load is applied to the baton, noise is reduced and the motor life is increased.

What is claimed is:

1. An electronic metronome comprising: a tempo synthesizing circuit for receiving the output signal from a reference oscillator; a rhythm signal generating circuit for receiving the output signal from said tempo synthesizing circuit; a speaker for generating a sound in response to the output from said rhythm signal generating circuit through a stress rhythm sound synthesizing circuit; a stepper motor driving signal generating circuit for receiving the output from said tempo synthesizing circuit; a stepper motor connected to be driven by said stepper motor driving signal generating circuit; and a reduction gear assembly equipped with a baton and connected to be driven by said stepper motor; so as to reciprocatingly drive said baton.

2. The electronic metronome as defined in claim 1; further including a power controlling circuit disposed between said stepper motor driving signal generating circuit and said stepper motor, said power controlling circuit including a pulse generating circuit for changing a duty ratio of the signal from said tempo synthesizing circuit and coacting with said stepper motor driving signal circuit for applying to said stepper motor a comb-tooth pulse effective to make the driving torque of said stepper motor substantially uniform.

3. In an electronic metronome having a baton which is reciprocatingly driven by a step motor powered by a voltage source whose output voltage varies: voltage detecting means for detecting the output voltage level of the voltage source and producing a corresponding voltage detection signal; and circuit means for generating drive pulses each composed of a plurality of individual pulses and applying the drive pulses to the step motor to rotationally drive the step motor in alternating forward and reverse directions of rotation to effect reciprocation of the baton, the circuit means including means responsive to the voltage detection signal for varying the pulse width of the individual pulses of each drive pulse in accordance with the variation of the output voltage of the voltage source.

4. An electronic metronome according to claim 3; wherein the circuit means comprises means for generating relatively low frequency pulses having a constant pulse width, means for generating relatively high frequency pulses having a pulse width which varies in accordance with the variation of the output voltage of the voltage source, and AND gate means receptive of both the low and high frequency pulses for producing therefrom drive pulses each composed of a plurality of individual high frequency pulses.

5. An electronic metronome according to claim 4; wherein the circuit means includes means for selectively setting the tempo at which the baton is to reciprocate, and means for adjusting the frequency of the drive pulses to control the speed of rotation of the step motor so as to effect reciprocation of the baton at the selected tempo.

6. An electronic metronome according to claim 5; wherein the means responsive to the voltage detection signal for varying the pulse width of the individual pulses includes means responsive to the selected tempo for varying the pulse width of the individual pulses of each drive pulse in accordance with both the variation of the output voltage of the voltage source and the selected tempo.

7. An electronic metronome according to claim 3; wherein the circuit means includes means for selectively setting the tempo at which the baton is to reciprocate, and means for adjusting the frequency of the drive pulses to control the speed of rotation of the step motor so as to effect reciprocation of the baton at the selected tempo.

8. An electronic metronome according to claim 7; wherein the means responsive to the voltage detection signal for varying the pulse width of the individual pulses includes means responsive to the selected tempo for varying the pulse width of the individual pulses of each drive pulse in accordance with both the variation of the output voltage of the voltage source and the selected tempo.

* * * * *